US005600077A

United States Patent [19]

Honda

[11] Patent Number: 5,600,077

[45] Date of Patent: Feb. 4, 1997

[54] DAMPER MECHANISM PROVIDED IN A GRAND PIANO

[75] Inventor: Hisamitsu Honda, Hamamatsu, Japan

[73] Assignee: Kabushiki Kaisha Kawai Gakki Seisakusho, Hamamatsu, Japan

[21] Appl. No.: 389,938

[22] Filed: Feb. 17, 1995

[30] Foreign Application Priority Data

Feb. 18, 1994 [JP] Japan ..... 6-021576

[51] Int. Cl.[6] ..... G10C 3/00

[52] U.S. Cl. ..... 84/216; 84/220; 84/171

[58] Field of Search ..... 84/216, 217, 218, 84/219, 221, 222, 223, 21, 23, 33, 34, 35, 36, 171, 172, 170, 220

[56] References Cited

U.S. PATENT DOCUMENTS 503,880 8/1893 Shearer ..... 84/220
1,540,739 6/1925 Jefferson et al. ..... 84/220
4,450,747 5/1984 Aoyama ..... 84/220
5,374,775 12/1994 Kawamura et al. ..... 84/171

*Primary Examiner*—Cassandra C. Spyrou
*Attorney, Agent, or Firm*— Davis and Bujold

[57] ABSTRACT

In a grand piano having an electronic sound source performance mode, a damper unit for stopping the movement of the hammer shanks in response to depression of the keys is provided. The damper unit has a relatively wide stop rail for halting the motion of the hammer shanks. Both ends of a support plate connected to the stop rail are pivotally supported by a pair of support mechanisms for pivotal motion in the longitudinal direction of the stop rail. In one of the pair of support mechanisms, a coil spring for urging the stop rail toward the support mechanism is provided. The stop rail is pulled toward the other support mechanism by an externally operated wire. Without changing the direction of the contact face of the stop rail for abutting on the hammer shank, the stop rail can be moved vertically between a stop position and a retracted position. In grand pianos, which have only a limited amount of available space above the hammer shank, the stop rail can be broadened.

12 Claims, 7 Drawing Sheets

DAMPER MECHANISM PROVIDED IN A GRAND PIANO

FIELD OF THE INVENTION

The invention relates to a damper mechanism provided in a grand piano for stopping the motion of hammer shanks in response to the depression of keys before the hammers strike the strings, thereby preventing generation of hammer striking sounds.

BACKGROUND OF THE INVENTION

Composite pianos are known in which an electronic sound source is combined with an acoustic piano. The composite piano can be played both in a normal piano performance mode in which the hammers strike the strings to produce sound, and in an electronic performance mode in which sound is produced by operating the electronic sound source. When such a composite piano is played in the electronic performance mode, the hammer striking sound is prevented by a stop rail that acts as a damper. When the hammer attached to the tip of a hammer shank is about to strike a string, the movement of the hammer shank is checked by the stop rail.

It is essential that the feel of the keys upon operating the keyboard is not influenced by the stoppage of the hammer shanks. For this purpose, the hammer shanks need to be stopped just prior to striking the strings. Therefore, the stop rail is preferably wide enough to stop the hammer shank abruptly and firmly.

In the conventional damper, as shown in FIG. 8, a stop rail 84 is supported on a support 82 such that the rail 84 is rotatable in the direction shown by an arrow. In the electronic performance mode the stop rail 84 is rotated to the stop position shown by a solid line, where the contact face, defined by a cushioning member 85 attached to the stop rail 84, contacts and stops the hammer shanks 86. In the normal piano performance mode, the stop rail 84 is rotated to the retracted position, shown by a dotted line, that is substantially perpendicular to the stop position. When the stop rail 84 is in the retracted position, the hammers 87 are allowed to strike the strings 81. Due to the limited amount of available space above the hammer shanks 86 in a grand piano, the width A of the stop rail 84 cannot be very large. Therefore, the desired feel of the keys upon operating the keyboard cannot be realized.

If the stop rail is narrow, the cushioning member on the stop rail is largely deformed after repeated contact with the hammer shank. Therefore, the hammer striking movement cannot be securely prevented over time and the hammer striking sound may be accidentally produced. To solve the problem, the hammers can be strictly prevented from striking the strings by displacing the stop rail down toward the hammer shanks. However, this causes the feel of the keys upon operating the keyboard to vary significantly between the electronic performance mode and the normal piano performance mode.

Conventionally, to eliminate the difference in the feel of the keys between the modes, the stop rail is first set to its upper limit position, such that the stop rail can check the movement of the hammer shanks just before the hammers strike the strings. By adjusting the mechanical unit for thrusting the hammer shanks up in response to depression of the keys, the hammer strikes caused by deformation of the cushioning member are prevented. Although such countermeasures can eliminate the difference in the feel of keys upon operating the keyboard, the adjustment in the mechanical unit adversely affects the characteristic piano tone during the normal performance mode. Therefore, when the keyboard is operated in the normal piano performance mode, in which the strings are struck by hammers in response to depression of the keys, the feel of keys is badly influenced.

The problem with the provision of a conventional damper is that it impairs the delicate feel of the keys demanded by grand pianos.

SUMMARY OF THE INVENTION

Wherefore, an object of the invention is to provide a damper mechanism having a wide stop rail for stopping the movement of the hammer shanks in grand pianos within the limited space available above the hammer shanks.

To attain this and other objectives, the invention provides a damper mechanism for a grand piano provided with a rail part for halting the movement of the hammer shanks by contacting the hammer shanks at specified stop positions just before the hammers strike the strings. A cushioning member is attached to the rail part for absorbing the shock caused when the hammer shanks impact upon the rail part. The rail part is pivotally supported by a support mechanism such that the rail part can move between the stop position in which the movement of the hammer shanks is restricted and the retracted position in which the hammers are allowed to strike the strings. The rail part, pivotally supported by the support mechanism, is moved into the stop position or the retracted position by a positioning mechanism. In the damper mechanism according to the invention, the support mechanism is composed of a pair of hangers for pivotally supporting both ends of the rail part such that the rail part can swing longitudinally along the length of the rail part. The positioning mechanism is composed of an urging member for longitudinally urging the rail part toward one of the hangers, thereby moving the contact face of the rail part from the stop position up to the retracted position. The positioning mechanism is also provided with a drawing member for pulling the rail part toward the other hanger against the force of the urging member, upon external operation or the drawing member, thereby moving the contact face of the rail part from the retracted position down to the stop position.

In the damper mechanism, the cushioning member is preferably composed of a plurality of cushioning materials having different hardnesses. The materials are sequentially laminated on the contact face of the rail part such that the softest material forms an external layer.

The cushioning members can alternatively be attached side by side along the length of the rail part. In this case, the relatively softer cushioning materials are thicker than the relatively harder materials. The cushioning materials are arranged such that the softest material contacts the hammer shanks first.

The height of the contact face of the rail part relative to the key bed of the grand piano can be adjusted for each tone range.

The rail part is preferably composed of a support rail having a plurality of stop rails mounted sequentially along the length of the rail part in respective tone ranges. The height and inclination of the contact face of the stop rails relative to the key bed can be adjusted by adjusting the attachment position of the stop rails on the support rail.

The width of the rail part is determined for each tone range, such that the rail part is narrower at the high tone strings. Also, the width of the rail part is determined according to the configuration of the frame around the pin plate to which tuning pins are attached.

Since the support mechanism is composed of a pair of hangers for pivotally supporting both ends of the rail part, the rail part simultaneously moves longitudinally and vertically in a swinging motion.

The rail part is longitudinally urged by the urging member toward one of the pair of hangers. When the urging force is exerted, the rail part is raised from its lowermost position. The contact face of the rail part is thus positioned in the retracted position, above the stop position in which the contact face contacts the hammer shank.

When the rail part is pulled against the force of the urging member toward the other hanger by external operation of the drawing member, the rail part is pulled down. The contact face of the rail part is thus positioned in the stop position.

In the invention, in order that the rail part can be displaced vertically while the contact face thereof remains facing toward the hammer shanks, both ends of the rail part are hung such that the part can swing in the longitudinal direction thereof. By moving the rail part longitudinally, the height of the part is changed in a translating swinging motion, with no rotation, and the contact face remains facing the hammer shanks at all times.

Consequently, in the invention, the rail part can be displaced between the stop position and the retracted position without changing the direction in which the contact face of the rail part faces. With this construction, although the space above the hammer shanks available for receiving the rail part is limited in grand pianos, the contact face of the rail part can be broadened relative to conventional dampers.

In the invention, the motion of the hammer shanks can be halted abruptly and firmly by the wide contact face of the rail part. Moreover, the string striking sound is prevented without adversely affecting the feel of keys.

The shock arising when the rail part impacts upon the hammer shanks is dispersed on the wide contact face of the rail part, thereby lengthening the life of the hammer shanks as well as of the rail part.

The relatively softer cushioning material is laid over the relatively harder material on the contact face of the rail part, such that the softest material contacts the hammer shanks first. The shock arising from the resulting impact contact is first absorbed by the softest material. Therefore, the noise as well as the force arising from the impact of hammer shank upon the rail part is effectively absorbed, thereby enhancing the durability of these components.

When the relatively soft and hard cushioning materials are arranged side by side along the length of the rail part, the relative softer materials are made thicker than the relatively harder materials, such that the softest material contacts the hammer shanks first and absorbs the contact shock.

In the damper of the present invention, by varying the height of the contact face of the rail part relative to the key bed of the grand piano in different tone ranges, the feel of all the keys can be the same over all the tone ranges.

In the grand pianos, the strings vary in height and inclination from one tone range to the next. Therefore, to make the feel of all the keys the same upon operating the keyboard, the height of the contact position of the rail part needs to be adjusted for each tone range. To that end, the thickness of the cushioning material attached to the contact face of the rail part can be different for each tone range, which is, however, intricate. Moreover, since the cushioning material directly receives the impact from the hammer shanks, the thicker the material is, the more the thickness of material changes over time. The stop position, where the movement of the hammer shank is stopped by the rail part, significantly deviates from the originally specified position as the material deforms.

In the invention, therefore, by adjusting the height at which the contact face of the rail part contacts the hammer shanks via the cushioning material for each tone range, the feel of all the keys upon operating the keyboard can be unchanged over time.

Further according to the invention, the rail part is composed of the support rail and a plurality of stop rails. The height and inclination of the contact face of each of the stop rails in the stop position can be set by adjusting the attachment position of the stop rails on the support rail. Consequently, the contact position or height at which the rail contacts the hammer shanks can be easily adjusted and set.

Since the contact position of the stop rails can be adjusted for each tone range, the stop position of the stop rails can be easily adjusted as the cushioning member is worn out over time. Alternatively, the cushioning member can be easily replaced with a new one.

The width of the rail is determined for each string tone range, such that the rail part is narrower at high tone strings of the piano. In grand pianos, the pin plate and frame extend above the mechanical unit. The overhanging amount of the pin plate as well as of the frame above the mechanical unit varies with the tone range and is larger for the high tone strings providing less available space for the damper. Since the rail part is narrower toward the high tone strings, when the rail part is raised to the retracted position, it is prevented from contacting the pin plate and frame. At the low tone strings, the available space above the mechanical unit is sufficient such that the rail part, as well as the contact face of the rail part, can be broadened.

The width of the rail part is further determined according to the configuration of the frame around the pin plate of the grand piano. Consequently, the rail part according to the invention is raised to the retracted position without contacting the pin plate or the frame, and the contact face of the rail part against the hammer shank can be broadened to the maximum extent possible.

BRIEF DESCRIPTION OF THE DRAWINGS

The invention will now be described, by way of example, with reference to the drawings, in which.

DETAILED DESCRIPTION OF THE PREFERRED EMBODIMENTS

A grand piano embodying the invention is a composite piano provided with a not shown electronic sound source from which electronic sounds are generated in response to operation of the keyboard. A player can play the grand piano by operating the keyboard and listening to the electronic sound through headphones, while the string striking sounds are not heard without headphones.

Figure 2:
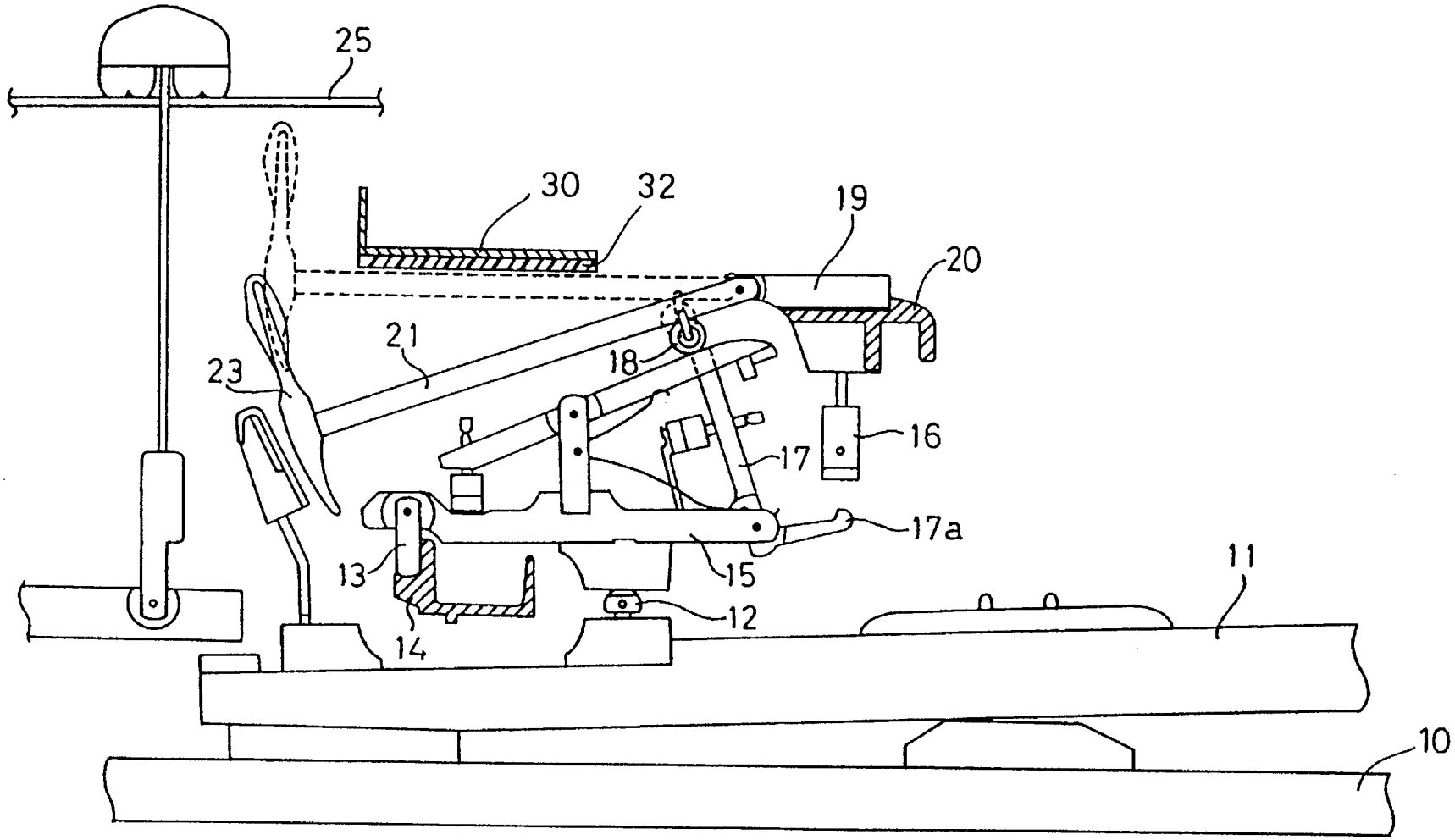
FIG. 2 is a diagrammatic representation showing the mechanical unit for one key of a grand piano provided with the damper mechanism of the first embodiment.

As shown in FIG. 2, the mechanical unit of the grand piano is composed of a key bed 10, a key 11, a capstan button 12, an action lever 15 pivotally supported via a wippen flange 13 on a wippen rail 14, and a regulating button 16. The mechanical unit is also provided with a jack 17 pivotally supported on the action lever 15 and having a jack tail 17*a*, a shank roller 18 abutting on the jack 17 in the stationary position, a hammer shank 21 pivotally supported via a flange 19 by a shank rail 20, and a hammer 23 attached to the tip of the hammer shank 21. When the key 11 is depressed upon operation of the keyboard, the capstan button 12 is raised and the action lever 15 is pivoted upwards. At the same time, the jack 17 is raised until the jack tail 17*a* contacts the bottom face of the regulating button 16. When the jack 17 is thus pushed upwards, the shank roller 18 is detached from the jack 17 and is raised, thereby pivoting the hammer shank 21 upwards, such that the hammer 23 moves up for striking a string 25.

Above the hammer shank 21, an L-shaped stop rail 30 is provided as a damper and a piece of urethane foam 32 is placed on the lower face of the rail 30 as a cushioning material. When the hammer 23 is about to strike the string 25, the hammer shank 21 contacts the stop rail 30 and is prevented from moving up any further. The vibration caused from the impact of the shank 21 is absorbed by the piece of urethane foam 32 attached to the stop rail.

Figure 1:
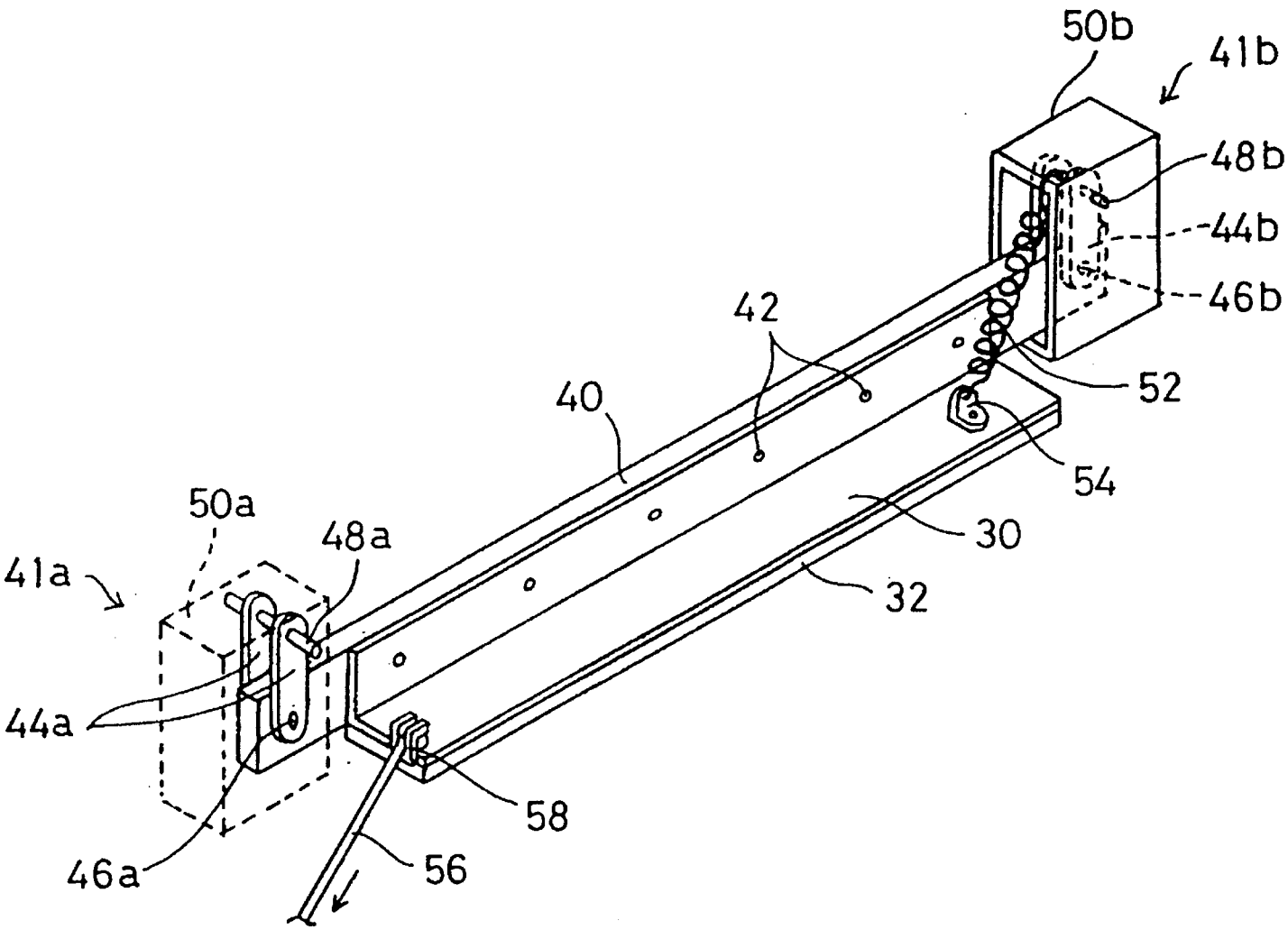
FIG. 1 is a perspective view diagrammatically showing the structure of a damper mechanism according to a first embodiment of the invention.

In the damper of the first embodiment, as shown in FIG. 1, the piece of urethane foam 32 is attached to the lower face of the horizontal portion of the L-shaped stop rail 30, while the vertical piece of the rail 30 is secured by screws 42 to a support rail 40. Both ends of the support rail 40 are pivotally supported by a pair of support mechanisms 41*a*, 41*b*, such that the support rail 40 is longitudinally pivoted or swung along its length. The support mechanism 41*b* is provided with a coil spring 52 for urging the stop rail 30 toward the mechanism 41*b*. In the support mechanism 41*a*, one end of a wire 56 is secured to the horizontal piece of the rail 30 and the other end of the wire 56 can be externally pulled toward the mechanism 41*a*.

In the support mechanism 41*a* the side faces of the support rail 40 are held by a pair of hangers 44*a*. The lower ends of the hangers 44*a* are pivotally secured to the support rail 40 by a lower shaft 46*a*, and the upper ends of the hangers 44*a* are pivotally secured to a case 50*a* by an upper shaft 48*a*. Similarly, in the support mechanism 41*b*, a pair of hangers 44*b* are pivotally secured to the support rail 40 by a lower shaft 46*b* and are pivotally secured to a case 50*b* by an upper shaft 48*b*.

One end of coil spring 52 is hooked in an eye in a fastener 54 mounted on the upper face of the horizontal portion of the stop rail 30, on the side opposite the hammer shank 21, while the other end of spring 52 is secured in a hole in the top face of the case 50*b* of the support mechanism 41*b*. In the support mechanism 41*a*, one end of wire 56 is detachably connected to a fastener 58 mounted on the stop rail 30.

Figure 3A:
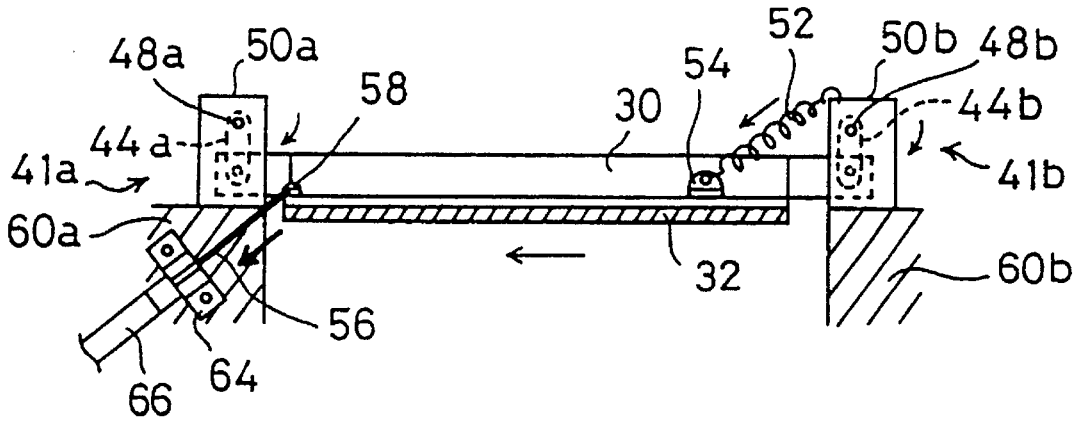
FIGS. 3A and 3B are explanatory views showing the operation of the damper mechanism of the first embodiment.
Figure 3B:
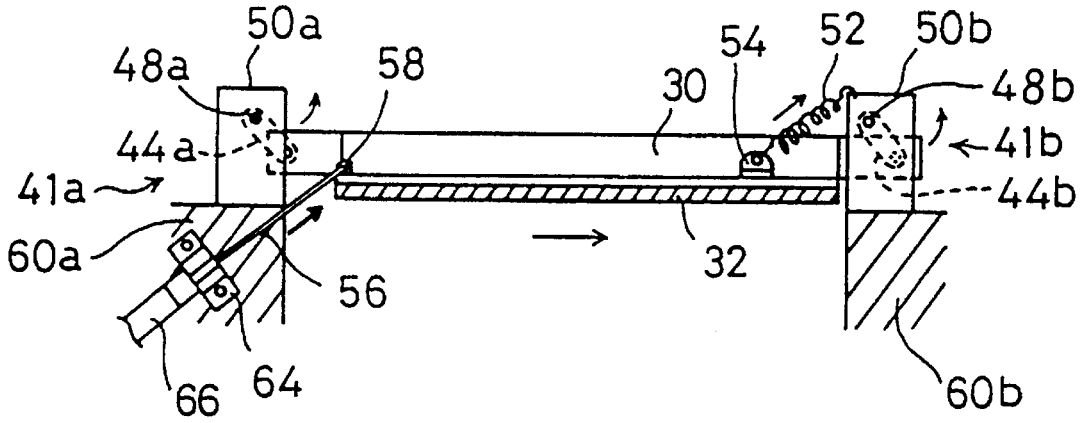

The damper of the first embodiment having the aforementioned structure, as shown in FIGS. 3A and 3B, is housed in a grand piano. The cases 50*a*, 50*b* with the pair of support mechanisms 41*a*, 41*b* housed therein are secured on base plates 60*a*, 60*b*, respectively, inside the side boards of the grand piano. As shown in FIG. 3A, by externally pulling the wire 56 toward the support mechanism 41*a*, the stop rail 30 is pulled down to the stop position, in which the hammer shanks 21 are stopped from moving up any further, thereby preventing the hammers 23 from striking the strings 25. As shown in FIG. 3B, when the wire 56 is released, the stop rail 30 is retracted to the original position, above the stop position, and the hammers 23 are allowed to strike the strings 25.

In the damper of the first embodiment, both ends of the support rail 40, with the stop rail 30 secured thereto, are pivotally secured by the pair of support mechanisms 41*a*, 41*b*, such that the stop rail 30 can move in the longitudinal direction. Further, in the support mechanism 41*b* the coil spring 52 is provided for urging the stop rail 30 toward the mechanism 41*b*, while in the support mechanism 41*a* the wire 56 is externally operated for pulling the stop rail 30 toward the mechanism 41*a*. In the stationary condition, in which the wire 56 is released, as shown in FIG. 3B, the stop rail 30 is urged by the coil spring 52 toward the support mechanism 41*b* and is raised to the retracted position. In this position the stop rail 30 does not engage the hammer shanks 21, thereby permitting the hammers 23 to strike the strings 25. When the wire 56 is externally pulled, the stop rail 30 is pulled against the force of coil spring 52 toward the support mechanism 41*a* and is pivoted or swung down to the stop position, thereby stopping the string striking movement of hammer shanks 21.

Different from the conventional damper, in which the contact face of the stop rail abutting on the hammer shanks is turned or changed as necessary, in the first embodiment the stop rail 30 can be easily moved in a swinging motion relative to the hammer shanks 21 between the stop position and the retracted position. Therefore, even in a grand piano having limited space for receiving the stop rail above the hammer shank 21, the abutment face of the stop rail 30 can be broadened.

Since the stop rail 30 has a wide face abutting on the hammer shank 21, the hammer shanks 21 can be firmly and abruptly stopped for dampening sound. Without changing the feel of the keys upon operating the keyboard, the string striking sound can be prevented.

The stop rail 30 is so wide that the impact arising from the hammer shanks 21 striking the stop rail 30 can be dispersed. Thus, the durability of the hammer shank 21, as well as that of the stop rail 30 can be enhanced.

As shown in FIGS. 3A, 3B, a tube 66 is fixedly connected to the base plate 60*a* via a fastener 64 and the wire 56 inserted through the tube 66. One end of the wire 56 is secured to the fastener 58 and the other end of the wire 56 is connected to a not shown operating lever provided on the under face of the key bed of the grand piano. By operating the lever, the wire 56 is drawn through the tube 66 and the stop rail 30 is pulled by the wire 56. The pull amount of the stop rail 30 or the stop position of the stop rail 30 is determined by the amount of wire 56 that is drawn through the tube 66 by the lever. Therefore, by adjusting the drawn amount, the stop position of the stop rail 30 for halting the motion of the hammer shank 21 can be easily set.

Figure 4A:
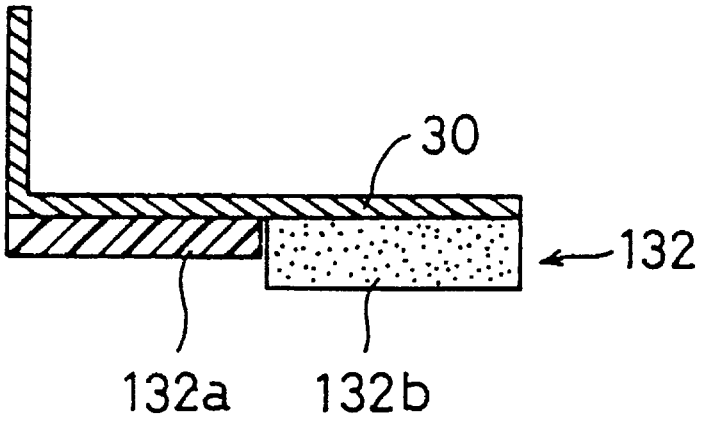
FIGS. 4A and 4B are cross-sectional views showing the cushioning materials attached to a stop rail according to the first embodiment.
Figure 4B:
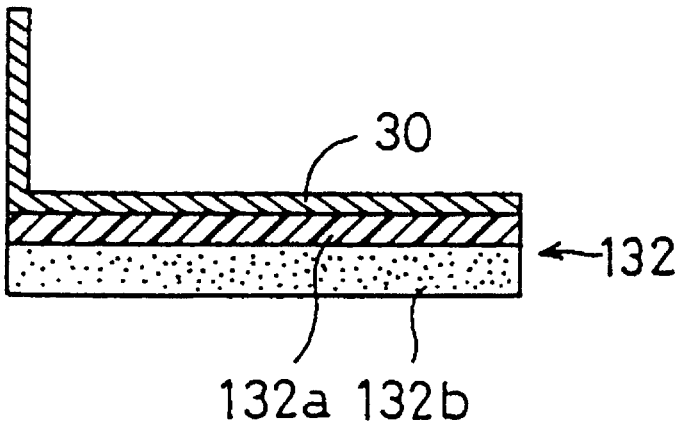

The cushioning member attached to the stop rail 30 is not limited to a piece of urethane foam 32. Two pieces of cushioning material 132, that differ in hardness, can be used. As shown in FIG. 4A, a relatively harder cushioning material 132*a* consisting of cloth and a relatively softer cushioning material 132*b* consisting of α-gel are placed side by side along the length of the stop rail 30. The softer cushioning material 132*b* is thicker than the harder cushioning material 132*a*. In this way the hammer shank 21 can strike the softer cushioning material 132*b* for dampening sound prior to striking the harder material 132*a*. Alternatively, as shown in FIG. 4B, the harder cushioning material 132*a* is first attached to the stop rail 30 and the softer cushioning material 132*b* is laminated over the harder material 132*a*. Also in this case, the hammer shank 21 strikes the softer cushioning material 132*b* prior to striking the harder material 132*a*.

When the cushioning material 132 is used, the impact shock of the hammer shanks 21 against the stop rail 30 is first absorbed by the softer cushioning material 132*b*, and is secondly absorbed by the harder cushioning material 132*a*. Thus, the impact shock and the noise is effectively absorbed in two stages. The durability of the hammer shank 21, as well as that of the stop rail 30, is enhanced.

In the aforementioned first embodiment, the stop rail 30 consists of one L-shaped piece. The width of the rail 30 is constant regardless of tone ranges. Whereas, in the damper of the second embodiment, the contact position or height of the stop rail 30 where it contacts the hammer shanks 21 is determined for each tone range in order that the feel of keys is constant over all the keys, the cushioning member needs to be divided in a longitudinal direction of the stop rail 30 and the width and inclination of each divided cushioning material need to be individually set for each tone range. Moreover, the width of the stop rail 30 in the first embodiment is the same along the length of the stop rail, regardless of tone ranges. Whereas the width needs to be adjusted to fit the minimal space available above the mechanical units of high tone strings, such that when the rail 30 is raised to its retracted position, it will not contact the pin plate or the frame. Although there is sufficient space above the mechanical units of low tone strings, the width of the stop rail 30 is adjusted to the limited space between the high tone strings and the mechanical unit.

Figure 5:
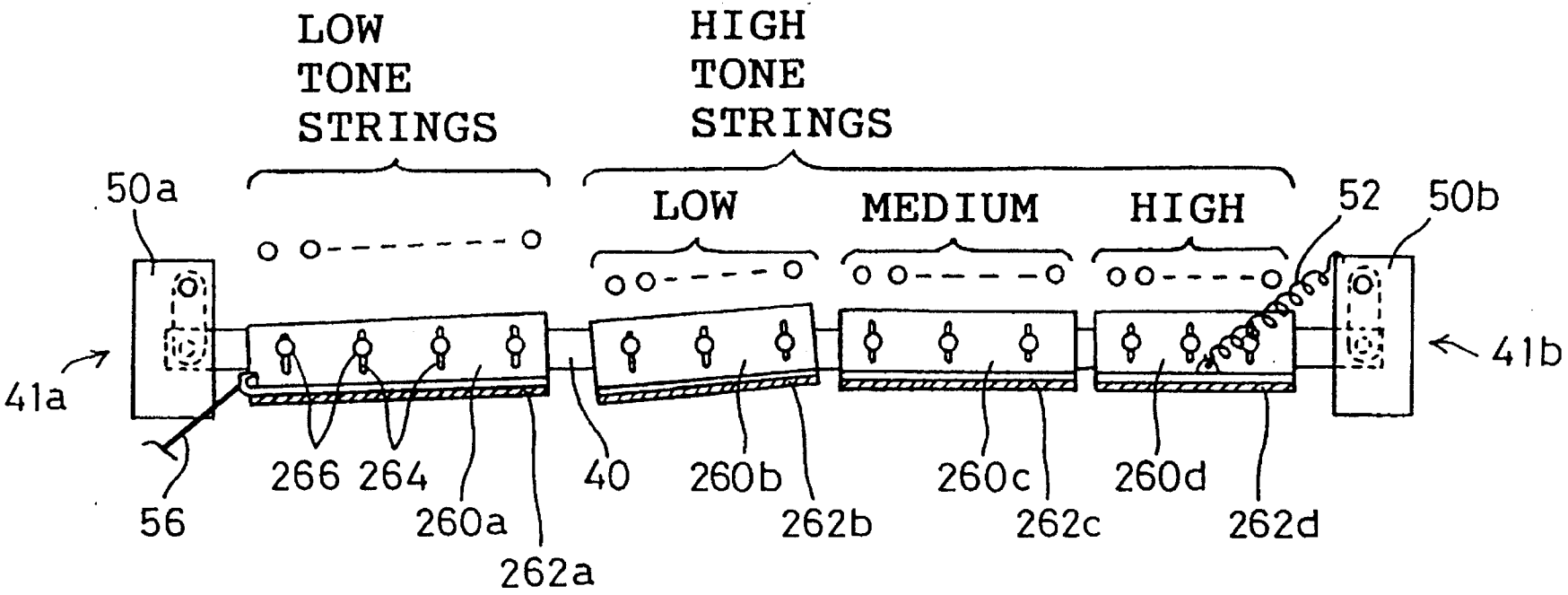
FIG. 5 is an explanatory view showing the damper mechanism of a second embodiment as viewed from the keyboard of the grand piano.
Figure 6:
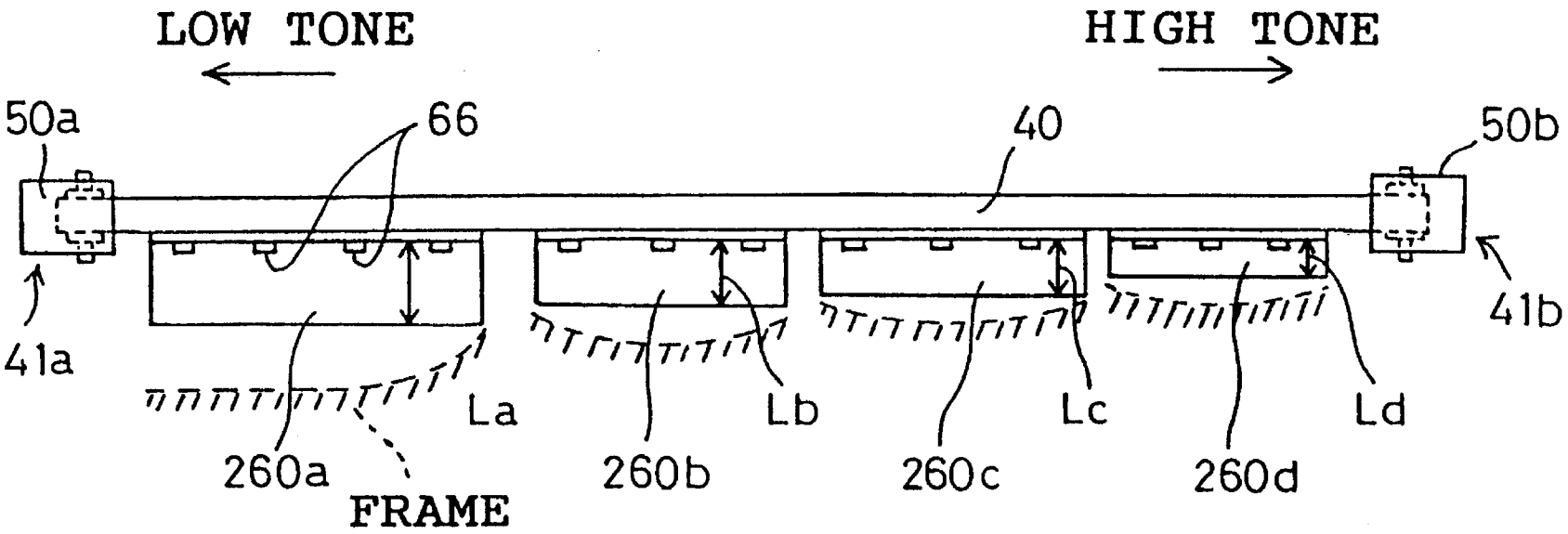
FIG. 6 is an explanatory view showing the damper mechanism of the second embodiment as viewed from the top of the grand piano.
Figure 7:
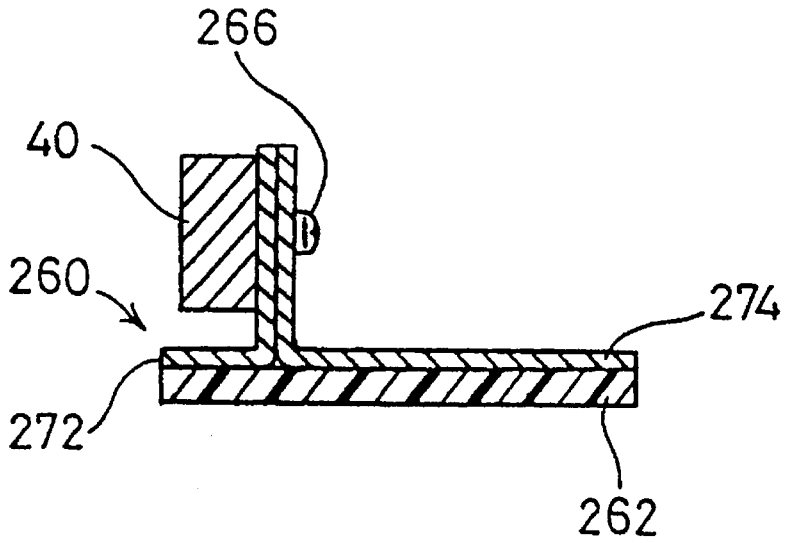
FIG. 7 is a cross-sectional view of the stop rail for use in the damper of the second embodiment.
Figure 8:
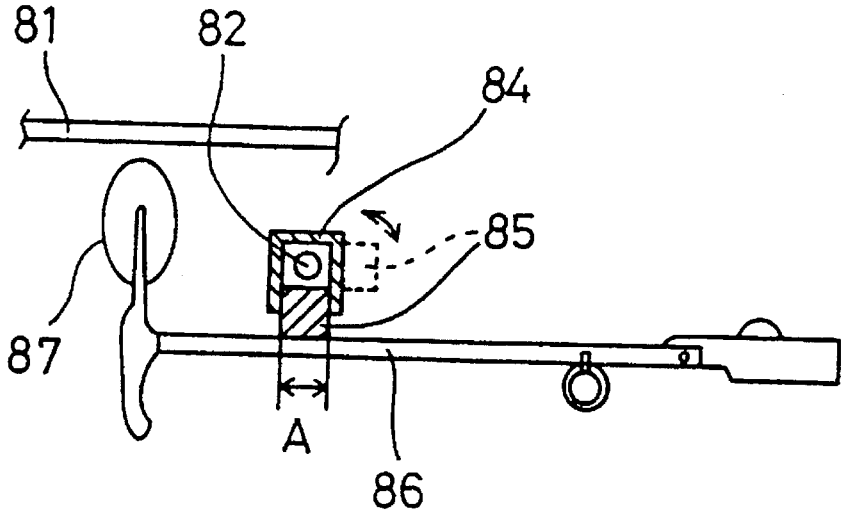
FIG. 8 PRIOR ART
FIG. 8 is an explanatory view showing a conventional damper mechanism.

To solve the problem, the second embodiment was developed as shown in FIGS. 5–7. In the damper of the second embodiment, the contact position or height of the hammer shank on the stop rail can be easily set for each tone range without adjusting the width or inclination of the cushioning materials. The width of the stop rail can thus be maximized to fit the available space above the mechanical unit.

The damper of the second embodiment is different from that of the first embodiment only in the configuration of the stop rail and in the attachment of the stop rail to the support rail. Therefore, the support mechanism and other similar structure are indicated by the same reference numerals as those of the first embodiment and are not explained in the description of the second embodiment contained below.

As shown in FIG. 5, the stop rail of the second embodiment is longitudinally divided into four sections according to tone ranges of the strings. The strings of grand pianos are roughly classified as high tone strings and low tone strings. The high tone strings are further classified into three or four tone ranges. Specifically, in the second embodiment, a stop rail 260 is divided into four stop rails 260*a*, one each for low tone strings, 260*b* for low range high tone strings, 260*c* for medium range high tone strings and 260*d* for high range high tone strings.

As shown in FIG. 7, each stop rail 260 forms a T-shape by attaching the vertical portions of two L-shaped rails 272 and 274. A cushioning material 262 is attached to the contact face of each stop rail 260 for impacting upon the hammer shanks 21 in each tone range. Since the stop rail 260 has an inverted T-shape, the contact face of the stop rail 260 can be elongated on its side adjacent the support rail 40.

As shown in FIG. 5, the stop rails 260*a*–260*d*, with cushioning material 262*a*–262*d*, are secured onto the support rail 40 by set screws 266 that extend through elongate holes 264 passing through the vertical portions of the stop rails 260*a*–260*d*. Three or four elongate holes 264 are located in each stop rail 260*a*–260*d* according to the length of the stop rail. The angle or inclination and height of the stop rails 260*a*–260*d* relative to the key bed of the grand piano are adjusted according to the inclination and height of the corresponding strings and the size of the hammer shank 21 abutting on the stop rails.

In the second embodiment, the height and inclination of the stop rails 260*a*–260*d* attached to the support rail 40 are adjusted by loosening the set screws 266, adjusting the attachment position of the corresponding stop rail by sliding the stop rail over the loosened set screws 266 received in the elongate holes 264, and tightening the set screws 266. Thus, the contact position and height of the stop rails 260*a*–260*d* are adjusted for each tone range.

As shown in FIG. 6, lengths La–Ld correspond to the distance that the stop rails 260*a* to 260*d* project from the attachment face of the support rail 40 toward the keyboard. The lengths La–Ld are determined according to the configuration of the frame provided above the mechanical unit of the grand piano. The length La in lowest tone range is longest and the lengths Lb to Ld become increasingly shorter approaching the high tone range. By setting the lengths La–Ld, the stop rails 260*a* to 260*d* are prevented from contacting the pin plate and frame above the mechanical unit when they are raised to the retracted position. At the same time, the width of the stop rails 260*a*–260*d* can be maximized.

In the second embodiment the stop rail 260 is composed of four rails 260*a* to 260*d*. The height and inclination of each rail relative to the key bed of the grand piano are adjustable. At the same time, the width of the rails is determined according to the configuration of piano frame, such that the width of the rail in high tone range is the shortest.

In the damper of the second embodiment, the contact position or height of the contact face can be easily adjusted for each tone range. The same touch can be felt on all of the keys upon operating the keyboard, irrespective of different heights of strings from the key bed of the grand piano. The width of the stop rail abutting on the hammer shank can be maximized while preventing the retracted stop rail from contacting the piano frame or other part of the piano.

In the second embodiment, the stop rail is divided into four sections. The number of divisions, however, can be changed according to the configuration of the grand piano or the inclination of the strings. For example, the stop rail can be divided into two sections: one for low tone strings and the other for high tone strings. The distance that the stop rails project from the support rail toward the keyboard can be varied in two stages: one for a low tone range and the other for a high tone range.

This invention has been described above with reference to the preferred embodiments as shown in the figures. Modifications and alterations may become apparent to one skilled in the art upon reading and understanding the specification. Despite the use of the embodiments for illustration purposes, the invention is intended to include all such modifications and alterations within the spirit and scope of the appended claims.

What is claimed is:

1. A damper unit for mounting in a grand piano having a plurality of strings, a key bed with a plurality of keys and a plurality of hammers on a plurality of hammer shanks that are operatively coupled to the keys for, upon depression of the keys, striking the strings via the hammers and creating string striking sound, said damper unit comprising:

two support hangers pivotally mounted inside the piano adjacent the strings and the hammers;

a support rail having a stop mechanism and two opposed ends, each of said two support hangers pivotally supporting one of the two opposed ends of said support rail such that said support rail is mounted longitudinally between the strings and the hammers for swinging motion of said support rail between i) a retracted position in which said stop mechanism is located out of a range of motion of the hammer shanks, in response to depression of the keys, for permitting the hammers to strike the strings and create string striking sound, and ii) a stop position in which the stop mechanism is located within the range of motion of the hammer shanks for contacting the hammer shanks and halting the motion of the hammer shanks, in response to depression of the keys, prior to the hammers striking the strings, thereby preventing the hammers from striking the strings and causing sound;

a positioning mechanism supported by the piano and operatively coupled to said support rail for selectively positioning said stop mechanism in said stop position and in said retracted position; and at least one of a height and an inclination of said contact surface, relative to a longitudinal axis of said support rail, being varied along the length of said support rail whereby, when said support rail is located in said stop position, at least one of the height and the inclination of said contact surface, relative to the key bed of the piano, is varied between tone ranges of the strings of the piano;

wherein said stop mechanism comprises:

a plurality of stop rail members, one for each said tone range, mounted sequentially along a length of said support rail;

each of said plurality of stop rail members has a contact surface and is adjustably mounted to said support rail for adjusting at least one of the height and the inclination of said contact surface relative to a longitudinal axis of said support rail, and thereby adjusting at least one of the height and the inclination of the contact surface relative to the key bed.

2. A damper unit according to claim 1, wherein a width of each said stop rail member is different for each said tone range such that said stop rail members are increasingly narrower approaching high tone strings of said piano.

3. A damper unit according to claim 2, wherein the width of each said stop rail member is determined according to available open space defined by a frame of said piano.

4. A damper unit according to claim 1, wherein each said contact surface is defined by cushioning material that substantially covers a surface of each said stop rail member facing said hammer shanks for absorbing shock that occurs when said hammer shanks impact against each said stop rail member.

5. A damper unit according to claim 4, wherein said cushioning material comprises a plurality of cushioning materials of different hardness that are laminated to said surface of each said stop rail member in order of hardness with a hardest of said materials laminated directly to each said rail member and a softest of said materials forming an outer layer of said contact surface.

6. A damper unit according to claim 4, wherein said cushioning material on each of said stop rail member comprises a plurality of cushioning materials of different hardness that extend parallel and adjacent to one another substantially entirely along a length of said surface of each said stop rail member that faces the hammer shanks, said plurality of cushioning materials having different thicknesses that vary according to the hardness of the material such that a softest of said materials is thickest and a hardest of said materials is thinnest.

7. A damper unit according to claim 1, wherein said positioning mechanism comprises a biasing member mounted between a frame of the piano and said support rail for biasing said support rail toward a first of said support hangers into said retracted position; and a drawing mechanism mounted on an outer surface of the piano and operatively connected to said support rail, whereby said drawing mechanism is actuatable for selectively urging said support rail in an opposite direction, against the force of said biasing member, toward a second of said support hangers into said stop position.

8. A damper unit for mounting in a grand piano having a plurality of strings, a key bed with a plurality of keys and a plurality of hammers on a plurality of hammer shanks that are operatively coupled to the keys for, upon depression of the keys, striking the strings with the hammers and creating string striking sound, said damper unit comprising;

two support hangers pivotally mounted in the piano adjacent the strings and the hammer shanks;

a support rail having a stop mechanism and two opposed ends, each of said two support hangers pivotally supporting one of the two opposed ends of said support rail such that said support rail is mounted longitudinally between the strings and the hammers for swinging motion of said support rail between i) a retracted position in which said stop mechanism is located out of a range of motion of the hammer shanks, in response to depression of the keys, for permitting the hammers to strike the strings and create string striking sound, and ii) a stop position in which the stop mechanism is located within the range of motion of the hammer shanks for contacting the hammer shanks and halting the motion of the hammer shanks, in response to depression of the keys, prior to the hammers striking the strings, thereby preventing the hammers from striking the strings and causing sound;

a biasing member mounted between a frame of the piano and said support rail for biasing said support rail toward a first of said support hangers into said retracted position; and a drawing mechanism mounted on an outer surface of the piano and operatively connected to said support rail, whereby said drawing mechanism is actuatable for selectively urging said support rail against the force of said biasing member in an opposite direction toward a second of said support hangers into said stop position;

wherein said stop mechanism comprises:

a plurality of stop rail members, one for each said tone range, mounted sequentially along a length of said support rail;

each of said plurality of stop rail members has a contact surface and is adjustably mounted to said support rail for adjusting at least one of the height and the inclination of said contact surface relative to a longitudinal axis of said support rail, and thereby adjusting at least one of the height and the inclination of said contact surface relative to the key bed.

9. A damper unit according to claim 8, wherein a width of each said stop rail member is different for each said tone range, such that said stop rail members are increasingly narrower approaching high tone strings of said piano, and the width of each said stop rail member is determined according to available open space in said piano.

10. A damper unit according to claim 8, wherein each said contact surface is defined by an outer surface of cushioning material that substantially covers a surface of each said stop rail member facing said hammer shanks for absorbing shock that occurs when said hammer shanks impact against said cushioning material.

11. A damper unit according to claim 10, wherein said cushioning material comprises a plurality of cushioning materials of different hardness laminated to said surface of each said stop rail member in order of hardness with a hardest of said materials laminated directly to each said stop rail member and a softest of said materials forming an outer layer of each said contact surface.

12. A damper unit according to claim 10, wherein said cushioning material on each of said stop rail member comprises a plurality of cushioning materials of different hardness that extend parallel and adjacent to one another substantially entirely along a length of said surface of each said stop rail member that faces the hammer shanks, said plurality of cushioning materials having different thicknesses that vary according to the hardness of the material such that a softest of said materials is thickest and a hardest of said materials is thinnest.

* * * * *